United States Patent [19]

Vogel

[11] 4,157,058

[45] Jun. 5, 1979

[54] LONG SEAM GLUER

[75] Inventor: Walter H. Vogel, Hoffman Estates, Ill.

[73] Assignee: Redington Inc., Chicago, Ill.

[21] Appl. No.: 857,263

[22] Filed: Dec. 5, 1977

[51] Int. Cl.[2] ..... B31B 1/54; B31B 1/78

[52] U.S. Cl. ..... 93/36.3; 93/49 R; 93/50; 93/53 SD

[58] Field of Search ..... 93/36.3, 46, 49 R, 50, 93/53 R, 53 SD, 62, 74; 271/271, 272, 275

[56] References Cited

U.S. PATENT DOCUMENTS

| | | | |
|---|---|---|---|
| 1,557,534 | 10/1925 | Swab | 93/74 |
| 1,734,742 | 11/1929 | Novick | 93/62 |
| 2,864,288 | 12/1958 | Engleson et al. | 93/53 |
| 3,122,071 | 2/1964 | Vogel | 93/53 |
| 3,956,976 | 5/1976 | Vogel et al. | 93/53 SD |
| 4,056,046 | 11/1977 | Hughes | 93/49 R |

FOREIGN PATENT DOCUMENTS

| | | | |
|---|---|---|---|
| 875803 | 8/1961 | United Kingdom | 93/62 |

*Primary Examiner*—Neil Abrams
*Attorney, Agent, or Firm*—Vogel, Dithmar, Stotland, Stratman & Levy

[57] ABSTRACT

A long seam gluer for folding a carton blank into cylindrical form and forming a glued seam between the outer surface of a glue flap and a glued area on an overlying side panel includes a magazine for holding a stack of carton blanks, feed mechanism for feeding carton blanks one at a time from the magazine in a predetermined direction with a longitudinal extent of the glue flap in the side panel normal to the predetermined direction, first folding mechanism for folding a first portion of the carton blank including the glue flap into a position overlying a remainder of the carton blank to leave exposed the outer surface of the glue flap, glue applying mechanism for applying a longitudinal body of glue to the glue flap as the glue flap is fed in the predetermined direction with the longitudinal extent of the glue flap normal to the predetermined direction, second folding mechanism for folding a second portion of the carton blank including the side panel into a position overlying a remainder of the carton blank to place the inner surface of the side panel over the body of glue on the glue flap, pressing mechanism to press and hold the side panel against the body of glue on the glue flap until the body of glue has set firmly to secure the glue flap to the side panel to form a flattened cylindrical carton, and a carton opening mechanism adjacent to the pressing mechanism for opening the flattened carton to receive an article therein.

38 Claims, 15 Drawing Figures

LONG SEAM GLUER

BACKGROUND OF THE INVENTION

The present invention relates generally to improvements in a long seam gluer, and specifically to the provision of a gluer wherein the glued seam is formed while the carton blank is moving in a direction such that the glued seam is normal to the direction of movement.

In one prior standard system utilized heretofore, the carton blank was fed flat in the direction of the longitudinal seam to be formed. Glue was applied to the glue flap in the longitudinal direction. Thereafter belts engaging the opposite sides of the carton blank folded the sides inwardly and into the usual overlapping condition with the glue lying therebetween, the belts then pressing the carton sides together until the glue had set. The cartons were formed into stacks and were fed to magazines in the packaging machinery which accepted the flattened tubular cartons and then expanded or opened the same prior to filling, see U.S. Pat. No. 2,864,288 granted Dec. 16, 1958 to Engleson and Sramek, U.S. Pat. No. 3,122,071 granted Feb. 25, 1964 to Vogel, and U.S. Pat. No. 3,956,976 granted May 18, 1976 to Vogel and Close.

In other standard practices, the carton was manufactured at the packaging machine using essentially the same technology as the independent carton manufacturing system set forth in the above. The flattened and seamed carton was sent to the standard carton expanding and erecting mechanism in the packaging machinery.

SUMMARY OF THE INVENTION

The present invention provides a long seam gluer wherein the seam is formed while oriented in a direction normal to the direction of movement of the carton blank through the gluer.

This is accomplished in the present invention, and it is an object of the present invention to accomplish these desired results, by providing a long seam gluer for folding a carton blank into cylindrical form and forming a glued seam between the outer surface of a glue flap and a glue area on the inner surface of an overlying longitudinal side panel, the gluer including a magazine for holding a stack of carton blanks on which a long glued seam is to be formed, feed mechanism for feeding carton blanks one at a time from the magazine in a predetermined direction with the longitudinal extent of the glue flap and the side panel normal to the predetermined direction, first folding mechanism for folding a first portion of the carton blank including the glue flap into a position overlying a remainder of the carton blank to leave exposed the outer surface of the glue flap, glue applying mechanism for applying a longitudinal body of glue to the glue flap as the glue flap is fed in the predetermined direction with the longitudinal extent of the glue flap normal to the predetermined direction, second folding mechanism for folding a second portion of the carton blank including the side panel into a position overlying a remainder of the carton blank to place the inner surface of the side panel over the body of glue on the glue flap, and pressing mechanism to press and hold the side panel against the body of glue on the glue flap until the body of glue has set firmly to secure the glue flap to the side panel.

Another object of the invention is to provide a long seam gluer of the type set forth, wherein the feed mechanism includes a suction cup mounted adjacent to the magazine for engaging a carton blank, and drive mechanism for the suction cup to draw the engaged carton blank from the magazine in a predetermined direction with the longitudinal extent of the glue flap and a side panel normal to the predetermined direction.

Still another object of the invention is to provide a long seam gluer of the type set forth, wherein the first folding mechanism includes a vacuum wheel adjacent to the feed mechanism and having at least one leading vacuum cup on the circumference thereof and at least one trailing vacuum cup on the circumference thereof spaced circumferentially from the leading vacuum cup, the feed mechanism delivering a carton blank to the vacuum wheel with a first portion of the carton blank including the glue flap extending circumferentially beyond the leading vacuum cup and with the remaining portion of the carton blank securely held against the vacuum wheel by the vacuum cups, and a folding finger engaging the first portion of the carton blank to fold the same into a position overlying the remaining portion of the carton blank to leave exposed the outer surface of the glue flap as the vacuum wheel and the folding finger are shifted relative to each other.

Still another object of the invention is to provide a long seam gluer of the type set forth, wherein the second folding mechanism includes an index folding wheel adjacent to the vacuum wheel beyond the glue applying mechanism and having a slot essentially diametrally therethrough to receive the first portion and the underlying remaining portion of the carton blank with the body of glue on the glue flap upon release of the leading vacuum cup, and drive mechanism for causing relative rotation between the vacuum wheel and the index folding wheel to move the carton blank therebetween to fold a second portion of the carton blank including the side panel into a position overlying a remainder of the carton blank to place the inner surface of the side panel over the body of glue on the glue flap.

Yet another object of the invention is to provide a long seam gluer of the type set forth, wherein the pressing mechanism includes a freely rotatable drum mounted adjacent to the second folding mechanism and arranged to receive the folded carton blank on the circumference thereof, and a belt engaging a portion of the circumference of the drum and arranged to receive the folded carton blank between the belt and the circumference of the drum to press and hold the side panel against the body of glue on the glue flap until the body of glue has set firmly to secure the glue flap to the side panel.

Still another object of the invention is to provide another form of pressing mechanism including a first freely rotatable drum mounted adjacent to the second folding mechanism and a second freely rotatable drum mounted in alignment with the first drum and spaced therefrom, a first belt around the drums with the first drum arranged to receive the folded carton blank on a portion of the first belt at the first drum, and a second belt engaging a major portion of the outer surface of the first belt and arranged to receive the folded carton blank therebetween to press and hold the side panel against the body of glue on the glue flap for an extended period of time until the body of glue has set firmly to secure the glue flap to the side panel.

A further object of the invention is to provide a long seam gluer of the type set forth that further includes a carton opening mechanism adjacent to the pressing mechanism for opening the flattened carton to receive an article therein.

A still further object of the invention is to provide components for a long seam gluer of the type set forth including an improved feed mechanism, an improved first folding mechanism, an improved second folding mechanism and improved pressing mechanisms, all as set forth hereinabove.

Further features of the invention pertain to the particular arrangement of the parts of the long seam gluer and the various components thereof, whereby the above outlined and additional operating features thereof are attained.

The invention, both as to its organization and method of operation, together with further features and advantages thereof will best be understood with reference to the following specification taken in connection with the accompanying drawings.

DESCRIPTION OF THE PREFERRED EMBODIMENTS

Figures 1, 2:
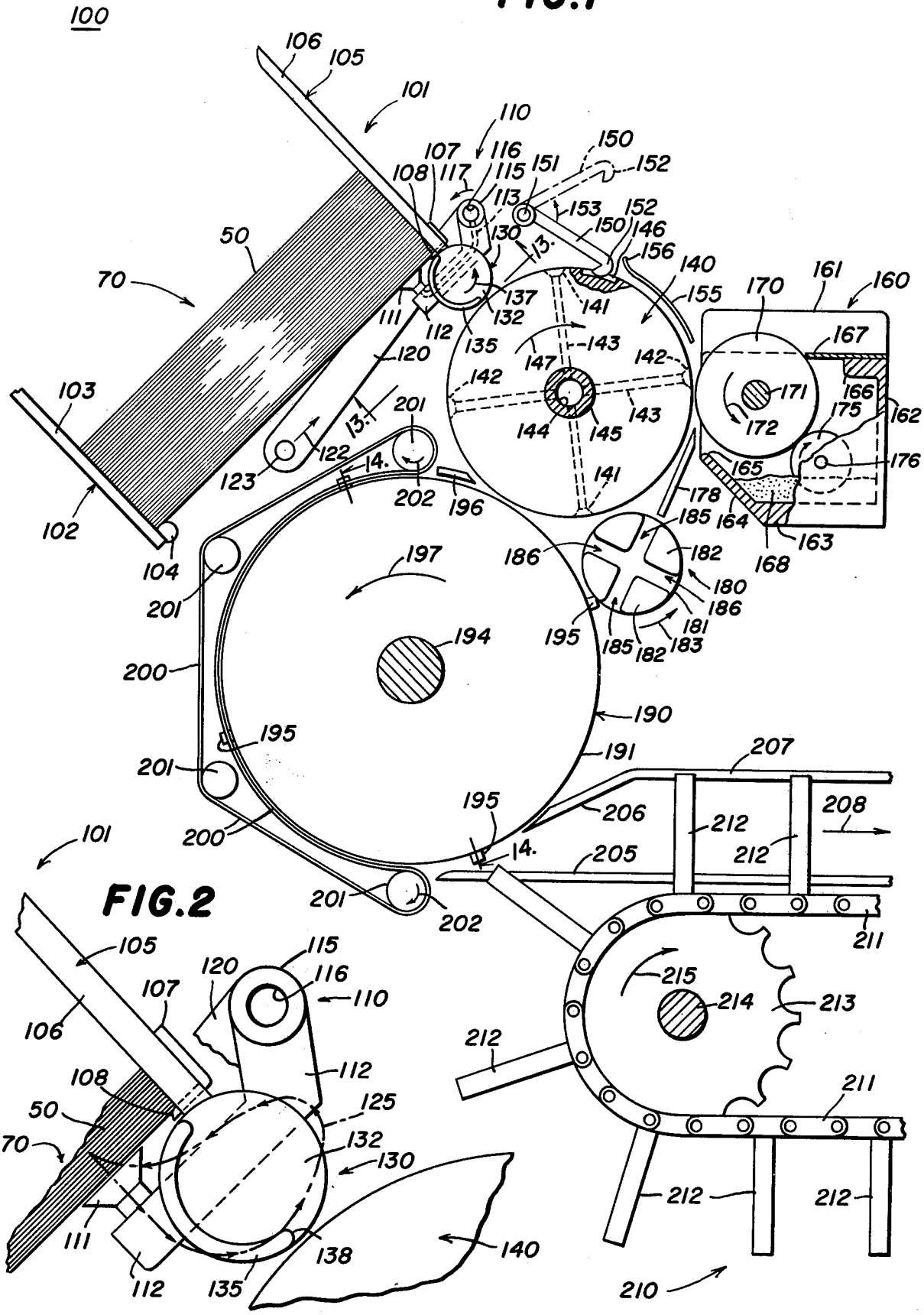
FIG. 1 is a side elevational view with certain portions broken away illustrating a first preferred embodiment of a long seam gluer made in accordance with and embodying the principles of the present invention.
FIG. 2 is a view on an enlarged scale showing the engagement between the vacuum cup of the feed mechanism and a carton blank in the magazine therefor.

Referring to FIG. 1 of the drawings, there is illustrated a long seam gluer generally designated by the numeral 100 made in accordance with and embodying the principles of the present invention, the long seam gluer 100 including a magazine 101 for holding a stack 70 of carton blanks 50, a feed mechanism generally designated by the numeral 110 for extracting cartons 50 from the magazine 101 one at a time, a vacuum wheel 140, a flap folding finger 150, a glue box 160, an index folding wheel 180, a drum 190 with a belt 200, and a carton conveyor 210.

Figure 11:
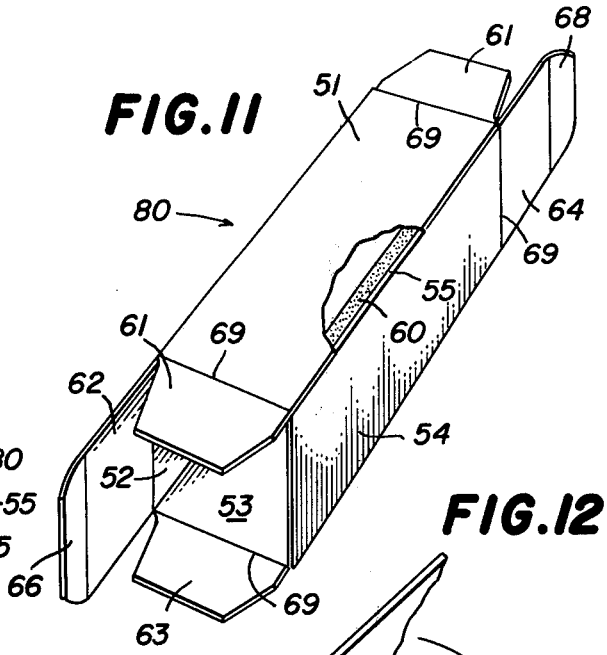
FIG. 11 is a perspective view with certain portions broken away of a finished and erected carton made by the long seam gluer of the present invention.
Figure 12:
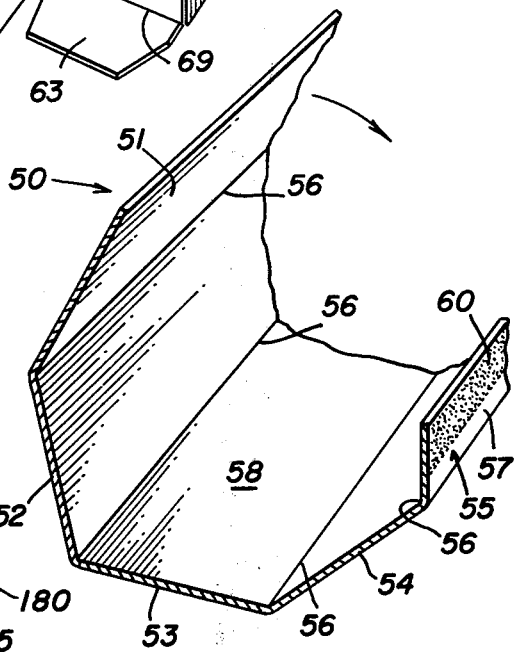
FIG. 12 is a fragmentary view of a carton blank used to make the carton in FIG. 11.

Referring to FIGS. 11 and 12, there is illustrated a carton blank 50 and the assembled carton 80 made therefrom utilizing the long seam gluer 100 of the present invention. The carton blank 50 includes four rectangular side panels 51 through 54, respectively, a glue flap 55 on one edge of the side panel 54, with score lines 56 defining the junctures of the side panels 51 to 54 and the glue flap 55. The carton blank 50 has an outer surface 57 and an inner surface 58, the outer surface 57 of the glue flap 55 receiving a glue body 60 during the operation of the long seam gluer 100. The carton blank 50 further has end flaps 61 on the side panel 51, an end panel 62 on the side panel 52, two end flaps 63 on the side panel 53 and an end panel 64 on the side panel 54. There further is provided a tuck flap 66 on the end panel 62 and a tuck flap 68 on the end panel 64. The various panels and flaps are defined by transverse score lines 69.

A stack 70 of the carton blanks 50 is disposed in the magazine 101 (see FIG. 1), the outer surface 57 being disposed downwardly and the inner surface 58 being disposed upwardly. The glue flap 55 is disposed to the upper right as viewed in FIG. 1 with the side flap 51 disposed to the lower left in FIG. 1, the longitudinal axes of the glue flap 55 and the side flap 51 being disposed normal to the sheet of drawings in FIG. 1.

The magazine 101 includes a bottom guide 102 having side flanges 103 with the bottom of the guide 102 closed by a cylindrical rod 104 that lies below and contacts the exposed surface of the side flap 51 of the adjacent carton blank 50. A top guide 105 is provided having side flanges 106, the glue flap 55 being held in position by a retaining flange 108 secured to the top guide 105 by a mounting flange 107. In order to remove the bottommost carton blank 50 from the magazine 101, the glue flap 55 must be pulled downwardly past the retaining flange 108, and the carton blank 50 then moved upwardly and to the right so that the side panel 51 can clear the rod 104.

Figure 3:
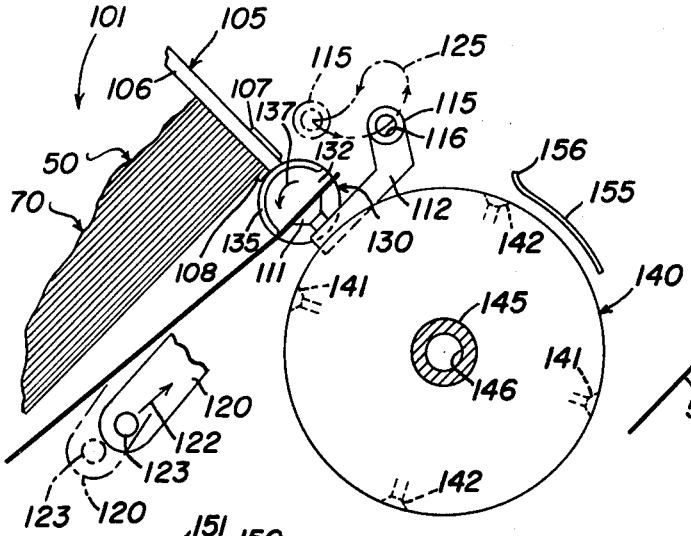
FIG. 3 is a fragmentary view of a portion of the long seam gluer of FIG. 1 and illustrating the carton blank magazine, the feeding mechanism and the vacuum wheel thereof.
Figure 13:
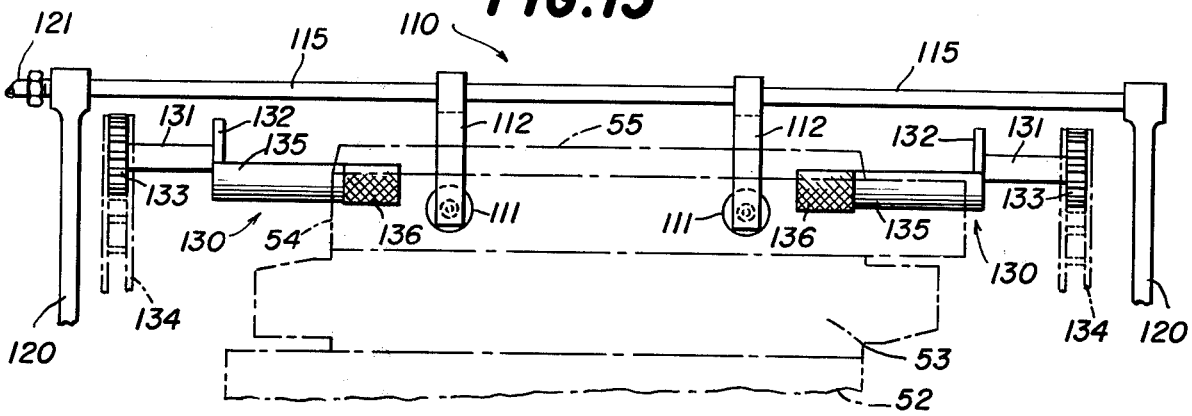
FIG. 13 is a view in the direction of the arrows along the line 13—13 of FIG. 1.

A carton blank feed mechanism 110 is disposed adjacent to the magazine 101 and is constructed and arranged to feed carton blanks 50 from the bottom of the stack 70 one at a time. In order to remove the bottommost carton blank 50, two suction cups 111 have been provided (see FIGS. 3 and 13 also), the suction cups 111 being mounted on support arms 112 that are in turn fixedly secured to a cross shaft 115. A vacuum passage 113 connects with the center of the associated vacuum cup 111 and extends through the associated support arm 112 and communicates with a passage 116 running through the shaft 115, the passage 116 being connected by a vacuum connection 121 to a source of vacuum or reduced pressure. The shaft 115 is supported by two control arms 120 that in turn are mounted on a transverse shaft 123. Drive mechanism (not shown) serves to pivot the support arms 112 in the direction of the arrow 117, thus to withdraw the bottommost carton blank 50 from the stack 70 due to the engagement with the suction cups 111, and thereafter the control arms 120 are shifted in the direction of the arrows 122 so as to move the suction cups upward and to the right as viewed in FIGS. 1, 2 and 3. As a result, the centers of the vacuum cups 111 move along the path 125 in FIG. 2 and in the direction of the arrows therealong, the path being essentially tear-shaped and serving initially to withdraw the lowermost carton blank 50 from the stack 70 past the retaining flange 108, and thereafter to shift the engaged carton blank 50 upwardly and to the right.

Figure 4:
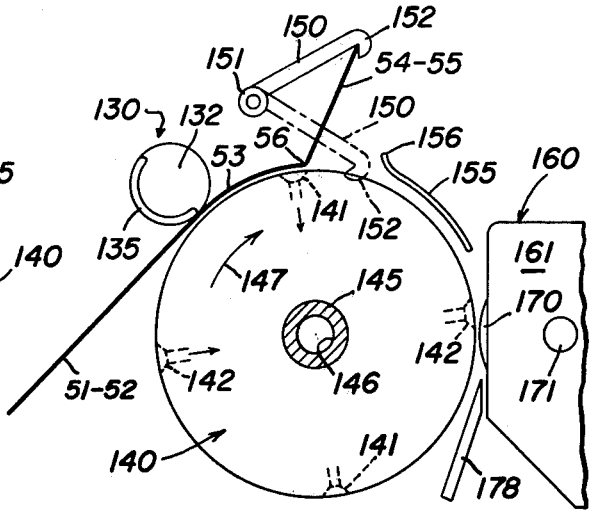
FIGS. 4 to 9 are fragmentary views illustrating the stepwise progress of a carton blank through the long seam gluer of FIG. 1.

Associated with the suction cups 111 are two segment rolls 130 (see FIG. 13 also), the segment rolls extending around approximately an 180° arc. Each of the segment rolls 130 is mounted on a shaft 131 carrying a hub 132 on one end thereof and a gear 133 at the other end thereof. The half-cylindrical body 135 of each of the segment rolls 130 is secured to the adjacent hub 132, and carries on the outer surface thereof a knurled surface 136, the better to grip the adjacent surface of the engaged carton blank. The gears 133 are engaged by drive chains 134 that rotate the segment rolls 130 in unison and in cooperation with the suction cups 112, the segment rolls 130 being rotated in the direction of the arrow 137 in FIG. 1. Each of the segment rolls 130 has a leading edge 138 on the body 135 thereof which passes around the leading edge of the carton blank 50 as it is withdrawn by the suction cups 111, the leading edge 138 then moving over the carton blank 50 to engage the inner surface 58 thereof as viewed in FIG. 3, with the segment rolls 130 thereafter serving to urge the engaged carton blank 50 against the surface of the vacuum wheel 140, (see FIG. 4 also), thus to insure proper engagement of the carton blank 50 with the vacuum wheel 140.

The vacuum wheel 140 is mounted adjacent to the feed mechanism 110 with the surface of the vacuum wheel 140 spaced away from the outer surfaces of the segment rolls 130 a distance just to receive a carton blank 50 therebetween. Disposed around the circumference of the vacuum wheel 140 are two sets of leading vacuum cups or suction openings 141 and two sets of trailing vacuum cups or suction openings 142. Preferably there are three vacuum cups 141 in each of the leading sets, with the two leading sets of vacuum cups 141 spaced apart radially 180°. Likewise, there are three vacuum cups 142 in each set thereof, and the two sets of vacuum cups 142 are disposed 180° apart and trailing the associated set of vacuum cups 141 by 90°. Each of the vacuum cups 141 and 142 is connected by an opening 143 through suitable valves (not shown) to a vacuum passage 144 disposed in the shaft 145 that supports the vacuum wheel 140.

Mounted above the vacuum wheel 140 is a plurality of flap folding fingers 150, only one of the fingers 150 having been illustrated in the drawings in the interest of clarity. Each finger 150 is mounted upon a shaft 151 and can be pivoted in the direction of the arrow 153 between the solid line position of FIG. 1 and the dashed line position therein. The outer end of each finger 150 carries a hook 152 which in the solid line position of FIG. 1 extends downwardly into a recess 146 that is disposed ahead of the associated set of leading vacuum cups 141. It is to be understood that each of the sets of vacuum cups 141 has a like set of recesses 146, the number of recesses 146 in each set thereof corresponding to the number of fingers 150. The fingers 150 serve to engage the leading edge of the carton blank on the vacuum wheel 140, and upon pivoting upwardly of the fingers 150 from the dashed line position in FIG. 4 to the solid line position therein, coupled with the continued rotation of the vacuum wheel 140 in the direction of the arrow 141 serves to permit the fingers 150 not only to engage the leading edge of the carton blank 50, but to fold the glue flap 55 and the side panel 54 upwardly along one of the score lines 56. Disposed to the right of the fingers 150 is a guide 155 having an outturned entry flange 156 which serves to receive the folded carton blank thereunder and thus to feed the folded carton blank to the glue box 160 with the outer surface 157 of the glue flap 55 disposed outwardly and disposed toward the glue box 160.

Disposed to the right of the vacuum wheel 140 as viewed in FIGS. 1 and 4 to 8 is the glue box 160 which is used to apply a body of glue in the form of a longitudinal line upon the glue flap 55 as it passes by the glue box 160. The glue box 160 includes two side walls 161 (see FIG. 1), a rear wall 162, a bottom wall 163 and an upwardly inclined front wall 164. The named walls cooperate to provide a liquid-tight enclosure for receiving a body of glue 168 in the bottom thereof. The front of the glue box is open above the edge 165 of the front wall 164 and the rear of the glue box has an inwardly directed flange 166 thereon that carries a forwardly directed scraper 167, the operation of which will be described more fully hereinafter.

Mounted within the glue box 160 is a glue roll 170 mounted upon a shaft 171 supported by the side walls 161 and adapted to turn and be driven in the direction of the arrow 172 in synchronism with the drive on the vacuum wheel 130. The cylindrical surface of the glue roll 170 is formed smooth except for one portion which is etched to provide a depression for retaining glue therein, the depression being in the form of the longitudinal glue body to be applied to the outer surface of the glue flap 55 on the carton blank 50. Mounted below and to the right of the glue roll 170 is a pick-up roll 175 mounted for rotation on a shaft 176 that is also mounted in the side walls 161. The pick-up roll 175 extends downwardly into the body of glue 168 in the bottom of the glue box 160 and serves to apply a uniform coating of the glue 168 to the outer surface of the glue roll 170. The scraper 167 serves to scrape all of the glue from the surface of the glue roll 170 except for the etched and depressed portion thereof that corresponds to the body of glue to be applied to the glue flap 55 on the carton blank 50. As a consequence, as the carton blank 50 is fed from the position illustrated in FIG. 4 to the position illustrated in FIG. 5, a body of glue is deposited upon the glue flap 55 of the carton blank 50.

As the carton blank 50 is fed past the glue box 160, it engages a guide 178 that directs the partially folded carton blank 50 into the index folding wheels 180. Referring to FIGS. 1 and 5 to 10, the construction and operation of the index folding wheels 180 will be described in detail. Two of the index folding wheels 180 are provided, one engaging one end of the carton blank, and the other engaging the other end of the carton blank so as to avoid contact with the body of glue on the glue flap 55. Each of the index folding wheels 180 includes a hub 181 carrying a cylindrical body 182 thereon, there being formed through the body 182 two slots 185 and 186 disposed normal to each other. The index folding wheels 180 are driven by a Geneva mechanism in synchronism with the drive of the vacuum wheel 140, the Geneva mechanism serving to index the wheels 180 ninety degrees in the direction of the arrow 183 at appropriate times.

Figure 5:
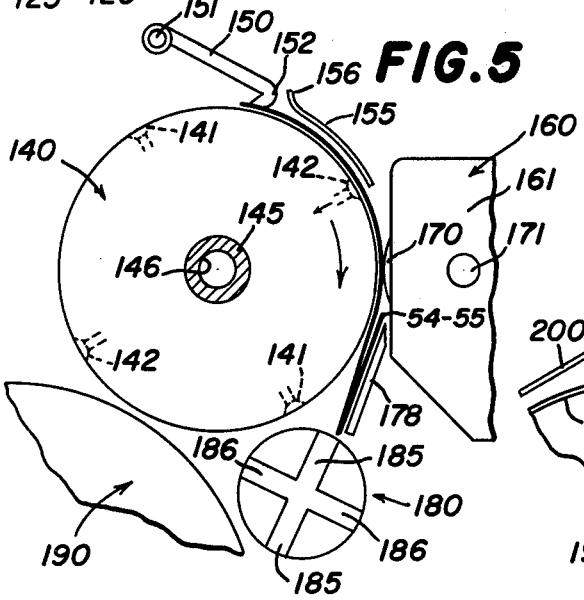
Figure 6:
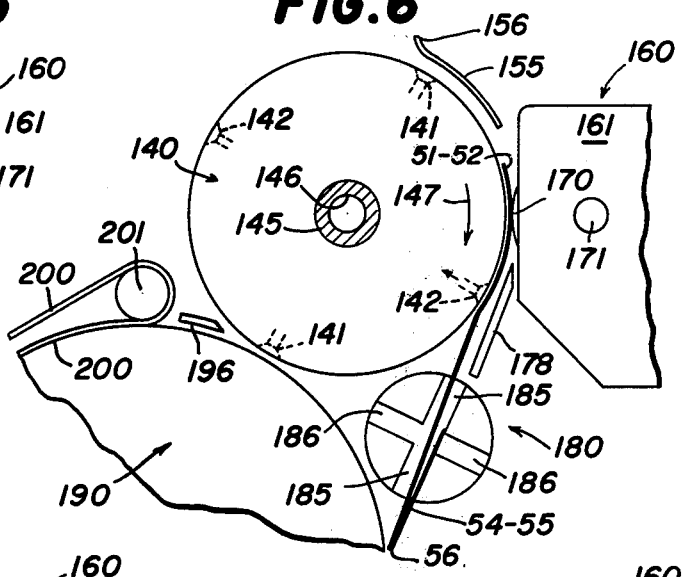
Figure 7:
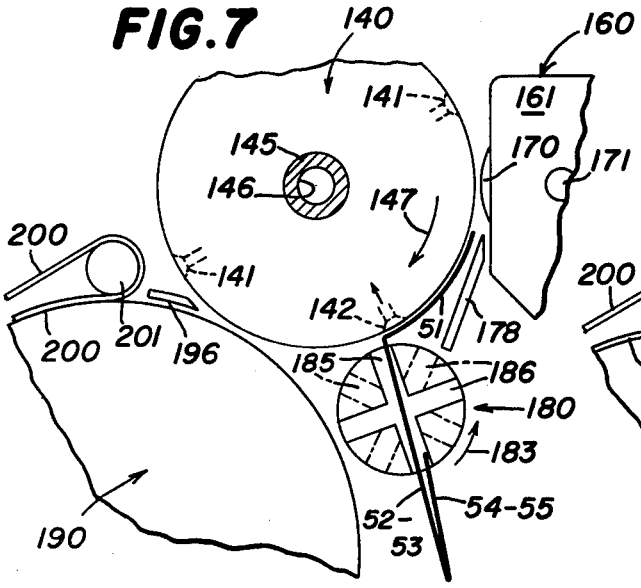
Figure 8:
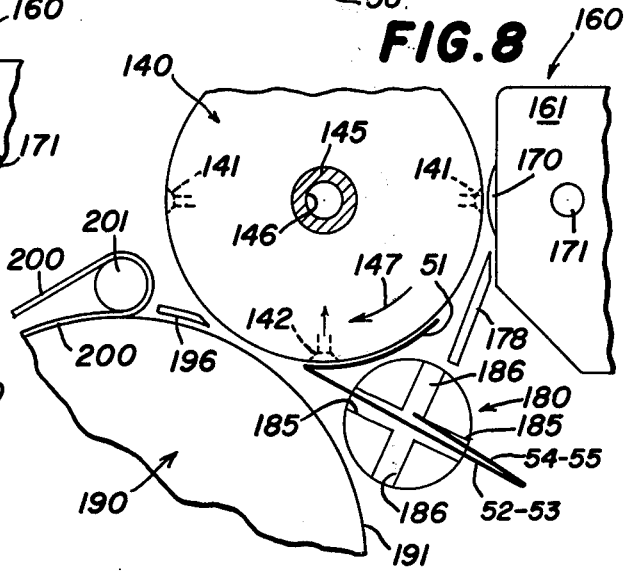

Referring to FIGS. 5 and 6 of the drawings, as the partially folded carton passes by the glue roll 170, the index folding wheels 180 are stationary with the slots 185 therein in alignment to receive the partially folded carton blank 50 from the guide 178, the guide 178 actually being in two sections and engaging only the outer edges of the carton blank 50 so as not to interfere with the line of glue on the glue flap 55. Likewise, the index folding wheels 180 engage only the outer portions of the carton blank 50 so as not to engage the body of glue on the glue flap 55. As the vacuum wheel 140 approaches the position in FIG. 5, the vacuum to the leading vacuum cups 141 is withdrawn which permits the leading edge of the carton blank 50 spring away from the circumference and periphery of the vacuum wheel 140 and guided by the guides 178 to move into the slots 185, and eventually to the position illustrated in FIG. 6. Thereupon, the Geneva mechanism indexes the wheels 180 through 90°, and more specifically from the position of FIG. 6 through the position of FIG. 7 and to the position of FIG. 8. Since the trailing vacuum cups 142 continue to hold a portion of the carton blank 50, a fold is created when the parts reach the position of FIG. 8 with the side panel 51 folded over and onto the glue flap 55, see FIG. 9. It should be appreciated that the inner surface of the panel 51 is now pressed against the body of glue on the glue flap 55 with the body of glue between the two surfaces, and it is needed only to maintain the parts of the carton blank 50 in this condition until the glue sets up in order to finish creating the desired glued connection.

Figure 14:
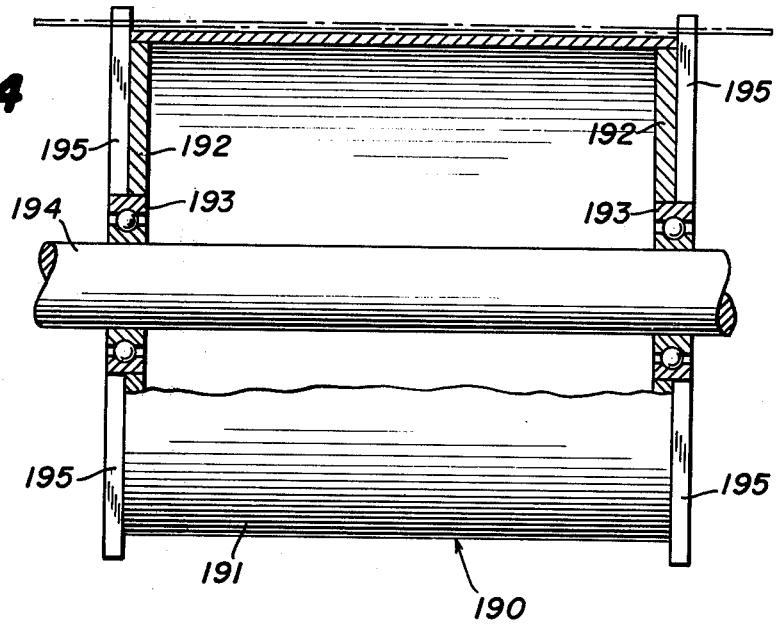
FIG. 14 is a view in the direction of the arrows along the line 14—14 of FIG. 1.

In order to press the side panel 51 against the glue flap 55 with the glue body 60 therebetween, a pressing mechanism has been provided in the form of the drum 190 and the cooperating belt 200. The drum 190 is mounted immediately adjacent to the vacuum wheel 140 so that the surface thereof can receive the folded carton blank 50 therebetween, and also the drum 190 is positioned near to the index folding wheel 180 so as to receive the trailing edge of the carton blank 50 therefrom. The drum 190 is mounted in a free-wheeling manner, the mounting being more particularly illustrated in FIG. 14 of the drawings. The drum 190 includes an outer cylindrical member 191 wrapped around two end plates 192 that are supported by ball bearing assemblies 193 and upon a central shaft 194. Due to this construction, the drum 190 is free to rotate upon the bearings 193, but does not impart any driving motion to the folded carton blanks or cartons thereon. Disposed outwardly on each side of the drum 190 are sets of lugs 195, there being four equiangularly arranged lugs 195 in each of the two sets, the lugs 195 being driven (by mechanism not shown) and engaging the outer portions of the folded carton blank 50 to drive the same through the pressing mechanism that comprises the drum 190 and the belt 200. Disposed adjacent to the surface 191 is a guide 196 which directs the carton blank 50 in a direction toward the belt 200.

The belt 200 is mounted upon four support pulleys 201, and also is free-wheeling, i.e., is not driven, all of the drive being derived from the lugs 195. The innermost reach of the belt 201 lies upon the surface 191 of the drum 190 around approximately 180° of the circumference thereof so as to press a folded carton blank 50 between the belt 200 and the outer surface of the drum 190, all in a free-wheeling condition, all drive being provided by the lugs 195. The diameter of the drum 190, and therefore the length of travel and contact with the belt 200, is chosen so that the glue body 60 sets up as the folded carton blank 50 passes around the drum 190 under the belt 200, the drum 190 moving in the direction of the arrow 197 and the belt moving in the direction of the arrows 202 on the pulleys 201.

Figure 10:
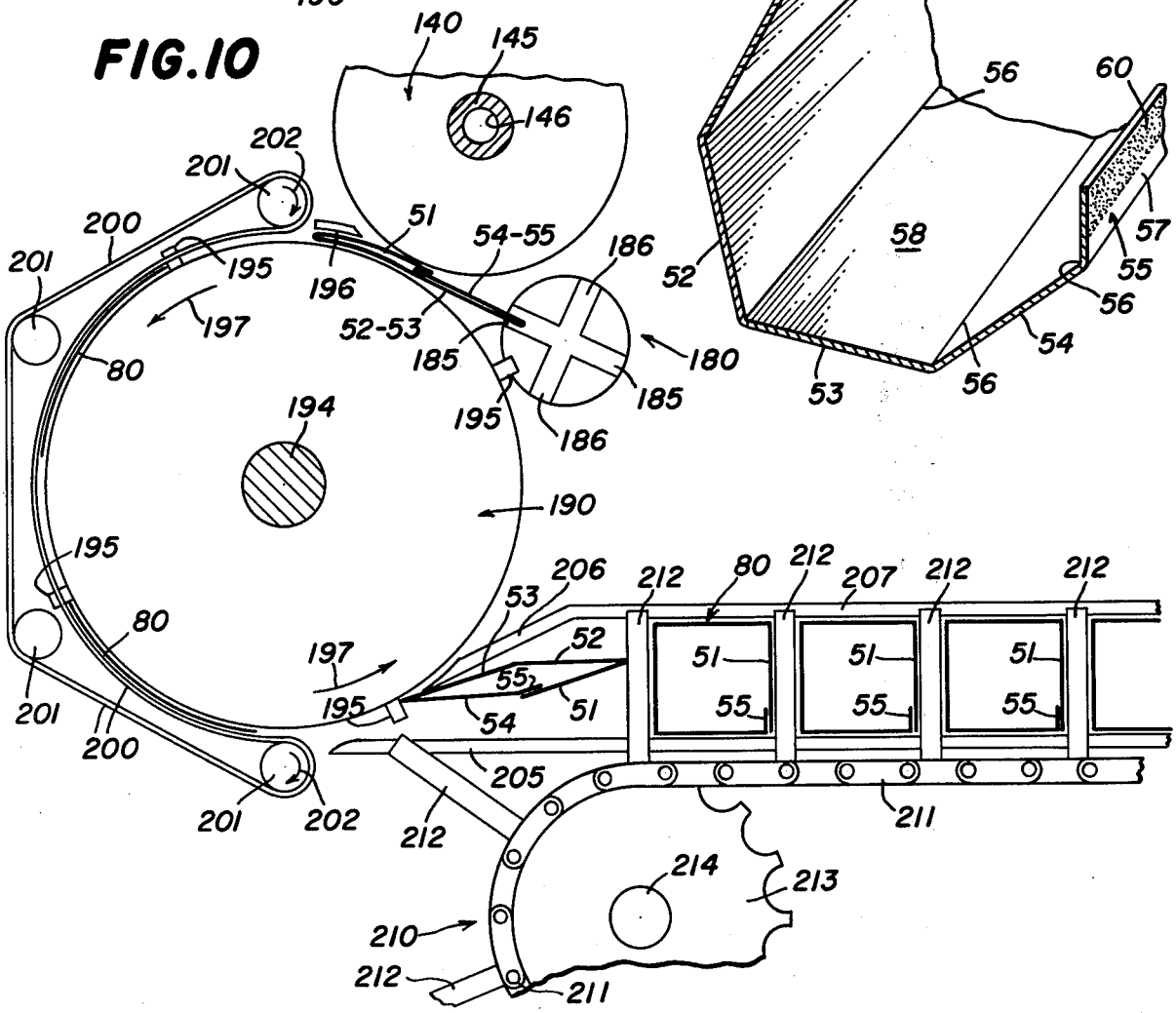
FIG. 10 is a view similar to FIG. 1, with certain portions broken away, illustrating the final steps in the carton forming and carton erecting operation performed by the long seam gluer of FIG. 1.

Positioned below and to the right of the drum 190 as viewed in FIGS. 1 and 10 is the carton conveyor 210 to which the completed cartons 80 are fed from the drum 190 by means of the lugs 195. The carton conveyor 210 includes an endless chain 211 that carries fingers or lugs 212 that are spaced apart a distance equal to the width of an expanded carton 80 along the upper reach of the chain 211 and which at the outer ends pivot outwardly as the chain 211 goes around a curved portion of the path thereof. The chain 211 is supported by gears 213 mounted on shafts 214 and moving in the direction of the arrow 215.

Associated with the carton conveyor 210 is a lower guide 205 that has a lefthand end disposed adjacent to the drum 190 at the point where the folded cartons 80 exit from between the outer surface of the drum 190 and the belt 200. The guide 205 extends to the right and above the chain 211 with the fingers 212 disposed thereby. Positioned above the lower guide 205 and extending upwardly is an inclined guide 206 that joins an upper guide 207 that is disposed parallel to the lower guide 205 and is spaced therefrom a distance equal to the height of the erected carton 80. The erected cartons 80 are moved by the carton conveyor 210 in the direction of the arrow 208 in FIG. 1 while the erected cartons 80 are held between the lower guide 205 and the upper guide 207.

Erection of the folded carton 80 is accomplished as best illustrated in FIG. 10 of the drawings. As the folded carton 80 leaves the lower end of the belt 200, the leading edge of the carton 80 strikes one of the fingers 212 and is pushed thereagainst by the action of the engaged lugs 195. This action initiates opening of the carton 80 and carries the carton 80 to the point where the trailing finger 212 now engages the trailing edge of the carton 80 as formerly engaged by the lugs 195. As the fingers 212 approach parallelism after going around the gear 213, the carton 80 is forced into the expanded and open condition thereof as illustrated to the right in FIG. 10, the carton 80 more particularly being disposed between two of the fingers 212 and being supported on the bottom by the lower guide 205 and being constrained at the top by the upper guide 207. The open cartons 80 are fed by the carton conveyor 210 to the filling station of the associated packaging machinery.

The operation of the long seam gluer 100 will now be described with particular attention to FIGS. 1 to 10 of the drawings. A quantity of the carton blanks 50 is placed in the magazine 101 with the glue flaps 55 disposed to the upper right and with the outer surfaces 57 disposed downwardly and inner surfaces 58 disposed upwardly. The first step in the operation is engagement of the suction cups 111 with the outer surface on the side panel 54 (see FIG. 2) of the lowermost carton blank 50, after which the support arms 112 are pivoted in a clockwise direction and thereafter shifted by means of the control arms 120 in the tear-drop shaped path 125. This brings the leading edge of the withdrawn carton blank under the segment rolls 130 (see FIG. 3) which serve to press the outer surface of the side panel 53 against the surface of the vacuum wheel 140, and particularly into engagement with the leading vacuum cups 141. It will be noted that the side panel 54 and the glue flap 55 are disposed forward of or leading with respect to the leading vacuum cups 141. The segment rolls 130 continue to press the balance of the carton blank 50 against the surface of the vacuum wheel 140 until the trailing vacuum cups 142 engaged the outer surface of the side panel 51.

In the meantime, the hooks 152 on the flap folding fingers 150 which were disposed in the recesses 146 (the solid line position in FIG. 1 and the dashed line position in FIG. 4) has engaged the leading edge of the carton blank 50, and more specifically, the glue flap 55, and has lifted the same away from the vacuum wheel 140 as the fingers 150 are pivoted in a counterclockwise direction while the vacuum wheel 140 continues to turn in a clockwise direction. This moves the side panel 54 and the glue flap 55 upwardly to the position illustrated in FIG. 4 and thereafter folds the side panel 54 and the glue flap 55 back onto a remaining portion of the carton blank 50, thus leaving the outer surface of the glue flap 55 exposed and directed outwardly. The partially folded carton blank then passes under the guide 155 and is presented to the glue roll 170 of the glue box 160.

The pick-up roll 175 transfers the glue from the body of glue 168 onto the surface of the glue roll 170 in a uniform manner, the scraper 167 removing the glue from all portions of the surface of the glue roll 170 except the etched portion that corresponds to the glue body to be placed upon the glue flap 55. The vacuum wheel 140 and the glue roll 170 are driven in synchronism, so that the portion of the surface of the glue roll 170 carrying glue is pressed against the outer surface of the glue flap 55 as the glue flap 55 passes thereby.

As the leading edge of the partially folded carton blank 50 reaches the guide 178, the vacuum to the vacuum cups 141 is interrupted, and the natural resilience in the carton blank 50 causes it to spring away and follow the guide 178 as illustrated in FIG. 5, continued rotation of the vacuum wheel 140 moving the leading edge of the partially folded carton blank 50 into the slots 185 in the index folding wheels 180, the index folding wheels 180 engaging only the outer ends of the carton blank 50 so as not to interfere with the body of glue 60 on the glue flap 55. The vacuum cups 142 are still in engagement and as the parts leave the position of FIG. 6 and approach the position of FIG. 7, the index folding wheels 180 are indexed 90° through the position of FIG. 7 and to the position of FIG. 8. The vacuum cups 142 are essentially in engagement with the side panel 51 and through this action the side panel 51 is folded over the remaining portion of the carton blank and when the parts reach the positions illustrated in FIG. 9, the inner surface of the side panel 51 is pressed against the glue body on the outer surface of the glue flap 55.

Figure 9:
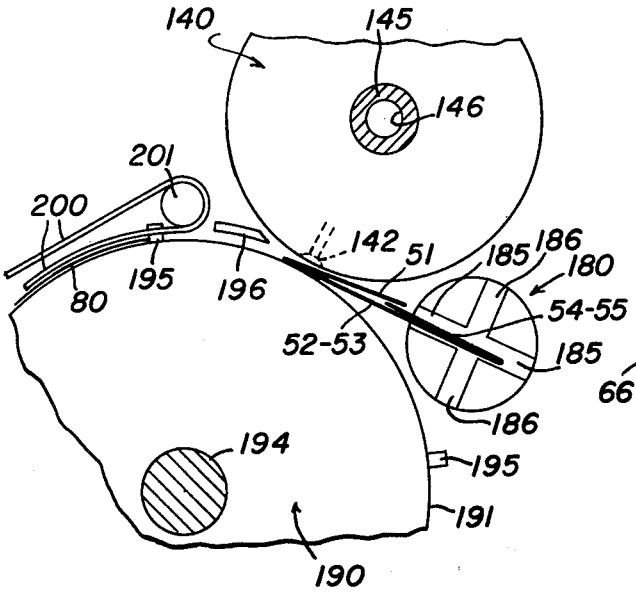

The vacuum cups 142 are disengaged essentially at the position illustrated in FIG. 9 and the momentum of the parts plus the driving by the lugs 195 of preceding carton blanks serves to cause the carton blank 50 illustrated in FIG. 9 to be fed under the guide 196 and then between the outer surface 191 of the drum 190 and the inner reach of the belt 200. This action presses the side panel 51 against the glue flap 55 and there results a completed carton 80, the carton 80 being in the flattened condition thereof. The lugs 195 now engage the trailing edge of the folded carton 80 and the parts are held in this condition as they are supported around the drum 190 under the belt 200, the time that the parts are thus held being such as to permit the body of glue to set up.

As the completed folded carton 80 reaches the underside of the drum 190 it is fed onto the lower guide 205 and against one of the fingers 212 on the carton conveyor 210. The lugs 195 continue to push the carton 80 against the finger 212 thus partially to open the carton 80, the carton 80 being constrained in upward motion by the inclined guide 206 and the upper guide 207. As the trailing finger 212 abuts against the trailing edge of the carton 80 to move the carton 80 away from the lugs 195, the carton 80 is forced into a further erected position, and when the fingers 212 move to the upper reach of the chain 211 so that the longitudinal axes of the fingers 212 are in parallelism, the carton 80 is fully erected. More specifically, the carton 80 is confined between two parallel fingers 212 and rests upon the lower guide 205 and is restrained at the top by the upper guide 207. The thus erected carton 80 goes to the next station of the packaging machinery with which the long seam gluer 100 is associated.

Figure 15:
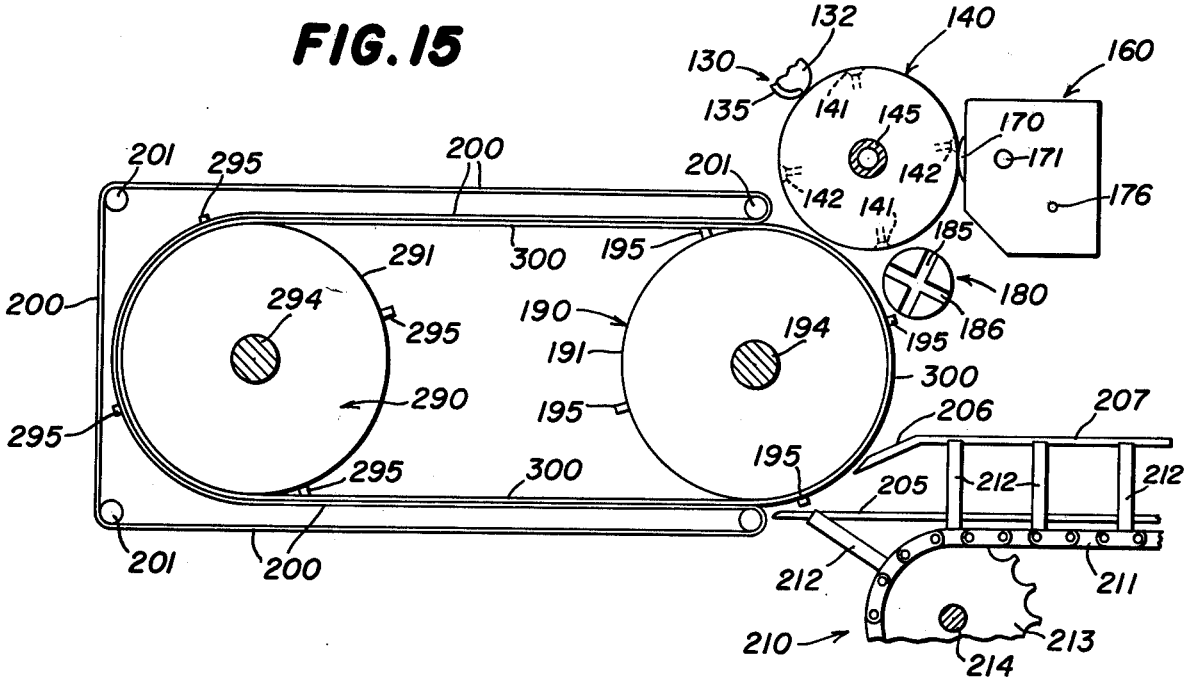
FIG. 15 is a view similar to FIG. 10 but illustrating a modification of the pressing mechanism thereof.

Referring to FIG. 15 of the drawings, there is shown a modification of the pressing mechanism wherein a longer time is provided to set up the glue on the glue flap 55. Many of the parts in the long seam gluer of FIG. 15 are identical in construction and operation to like parts in the long seam gluer of FIGS. 1 to 14, and therefore like reference numerals have been applied where appropriate.

In the form of the invention illustrated in FIG. 15, a second free wheeling drum 290 is provided spaced from the drum 190 and arranged in alignment therewith. The various parts of the drum 290 are identical in construction to like parts of the drum 190, and therefore numerals in the 200 series have been applied to the drum 290 that correspond to like numbered parts in the 100 series of the drum 190. Passing around the two drums 190 and 290 is a belt 300, the width of the belt 300 being essentially equal to the length of the glued seam to be formed. The inner reach of the belt 200 overlies the belt 300 from the vertical diameter of the drum 190 and around the lefthand portion of the drum 290 and overlying the reaches of the belt 300 extending between the drums 190 and 290. As a consequence, the folded cartons 80 pass from the index folding wheel 180 and onto the belt 300 and then under the belt 200 and are held between the belts 200 and 300 from the top of the vertical diameter point of the drum 190 all the way around the drum 290 and then back again to the lower vertical diameter point on the drum 190. This gives an extending drying and setup time for the glue on the glue flaps 55. From the belts 200 and 300, the completed carton is fed to the carton conveyor 210 as explained above with respect to the form of the invention illustrated in FIGS. 1 to 14.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A long seam gluer for folding a carton blank into cylindrical form and forming a glued seam between the outer surface of a glue flap and a glue area on the inner surface of an overlying longitudinal side panel, said gluer comprising a magazine for holding a stack of the carton blanks on which a long glued seam is to be formed, feed mechanism for feeding carton blanks one at a time from said magazine in a predetermined direction with the longitudinal extent of the glue flap and the side panel normal to the predetermined direction, first folding mechanism for folding a first portion of the carton blank including the glue flap into a position overlying a remainder of the carton blank to leave exposed the outer surface of the glue flap, glue applying mechanism for applying a longitudinal body of glue to the glue flap as the glue flap is fed in the predetermined direction with the longitudinal extent of the glue flap normal to the predetermined direction, second folding mechanism for folding a second portion of the carton blank including the side panel into a position overlying a remainder of the carton blank to place the inner surface of the side panel over the body of glue on the glue flap, and pressing mechanism to press and hold the side panel against the body of glue on the glue flap until the body of glue has set firmly to secure the glue flap to the side panel.

2. The long seam gluer set forth in claim 1, wherein said magazine is arranged so that the feed mechanism feeds the carton blanks from the bottom of the stack.

3. The long seam gluer set forth in claim 1, and further comprising guides for guiding the carton blanks from said first folding mechanism to said glue applying mechanism and from said glue applying mechanism to said second folding mechanism and from said second folding mechanism to said pressing mechanism.

4. A long seam gluer for folding a carton blank into cylindrical form and forming a glued seam between the outer surface of a glue flap and a glue area on the inner surface of an overlying longitudinal side panel, said gluer comprising a magazine for holding a stack of the carton blanks on which a long glued seam is to be formed, a suction cup mounted adjacent to said magazine for engaging a carton blank, drive mechanism for said suction cup to draw the engaged carton blank from said magazine in a predetermined direction with the longitudinal extent of the glue flap and the side panel normal to the predetermined direction, first folding mechanism for folding a first portion of the carton blank including the glue flap into a position overlying a remainder of the carton blank to leave exposed the outer surface of the glue flap, glue applying mechanism for applying a longitudinal body of glue to the glue flap as the glue flap is fed in the predetermined direction with the longitudinal extent of the glue flap normal to the predetermined direction, second folding mechanism for folding a second portion of the carton blank including the side panel into a position overlying a remainder of the carton blank to place the inner surface of the side panel over the body of glue on the glue flap, and pressing mechanism to press and hold the side panel against the body of glue on the glue flap until the body of glue has set firmly to secure the glue flap to the side panel.

5. The long seam gluer set forth in claim 4, wherein at least two suction cups are mounted to engage a carton blank in said magazine, said suction cups being spaced apart laterally in the direction of the longitudinal extent of the glue flap.

6. The long seam gluer set forth in claim 4, and further comprising at least one segment roll adjacent to said suction cup to aid in feeding of the carton blanks to the first folding mechanism.

7. A long seam gluer for folding a carton blank into cylindrical form and forming a glued seam between the outer surface of a glue flap and a glue area on the inner surface of an overlying longitudinal side panel, said gluer comprising a magazine for holding a stack of the carton blanks on which a long glued seam is to be formed, feed mechanism for feeding carton blanks one at a time from said magazine in a predetermined direction with the longitudinal extent of the glue flap and the side panel normal to the predetermined direction, a vacuum wheel adjacent to said feed mechanism and having at least one leading vacuum cup on the circumference thereof and at least one trailing vacuum cup on the circumference thereof spaced circumferentially from said leading vacuum cup, said feed mechanism delivering a carton blank to said vacuum wheel with a first portion of the carton blank including the glue flap extending circumferentially beyond said leading vacuum cup and with the remaining portion of the carton blank securely held against said vacuum wheel by said vacuum cups, a folding finger engaging the first portion of the carton blank to fold the same into a position overlying the remaining portion of the carton blank to leave exposed the outer surface of the glue flap as said vacuum wheel and said folding finger are shifted relative to each other, glue applying mechanism for applying a longitudinal body of glue to the glue flap as the glue flap is fed in the predetermined direction with the longitudinal extent of the glue flap normal to the predetermined direction, second folding mechanism for folding a second portion of the carton blank including the side panel into a position overlying a remainder of the carton blank to place the inner surface of the side panel over the body of glue on the glue flap, and pressing mechanism to press and hold the side panel against the body of glue on the glue flap until the body of glue has set firmly to secure the glue flap to the side panel.

8. The long seam gluer set forth in claim 7, wherein at least two leading vacuum cups are provided in longitudinal arrangement and at least two trailing vacuum cups are provided in longitudinal arrangement.

9. The long seam gluer set forth in claim 7, wherein said vacuum wheel is provided with two sets of leading vacuum cups arranged circumferentially around said vacuum wheel and at least two sets of trailing vacuum cups respectively associated with said sets of leading vacuum cups around the circumference of said vacuum wheel.

10. The long seam gluer set forth in claim 7, wherein a recess is provided in the surface of said vacuum wheel ahead of said leading vacuum cup to receive said folding finger therein to assist engagement of said folding finger with the leading edge of a carton blank.

11. The long seam gluer set forth in claim 7, wherein said vacuum wheel is rotated past said folding finger and said folding finger shifts away from and toward the circumference of said vacuum wheel to effect folding of the first portion of the carton blank.

12. A long seam gluer for folding a carton blank into cylindrical form and forming a glued seam between the outer surface of a glue flap and a glue area on the inner surface of an overlying longitudinal side panel, said gluer comprising a magazine for holding a stack of the carton blanks on which a long glued seam is to be formed, feed mechanism for feeding carton blanks one at a time from said magazine in a predetermined direction with the longitudinal extent of the glue flap and the side panel normal to the predetermined direction, a vacuum wheel adjacent to said feed mechanism and having at least one leading vacuum cup on the circumference thereof and at least one trailing vacuum cup on the circumference thereof spaced circumferentially from said leading vacuum cup, said feed mechanism delivering a carton blank to said vacuum wheel with a first portion of the carton blank including the glue flap extending circumferentially beyond said leading vacuum cup with the remaining portion of the carton blank securely held against said vacuum wheel by said vacuum cups, a folding finger engaging the first portion of the carton blank to fold the same into a position overlying the remaining portion of the carton blank to leave exposed the outer surface of the glue flap as said vacuum wheel and said folding finger are shifted relative to each other, glue applying mechanism for applying a longitudinal body of glue to the glue flap as the glue flap is fed in the predetermined direction with the longitudinal extent of the glue flap normal to the predetermined direction, an index folding wheel adjacent to said vacuum wheel beyond said glue applying mechanism and having a slot essentially diametrally therethrough to receive the first portion and the underlying remaining portion of the carton blank with the body of glue on the glue flap upon release of said leading vacuum cup, drive mechanism for causing relative rotation of said vacuum wheel and said index folding wheel to move the carton blank therebetween to fold a second portion of the carton blank including the side panel into a position overlying a remainder of the carton blank to place the inner surface of the side panel over the body of glue on the glue flap, and pressing mechanism to press and hold the side panel against the body of glue on the glue flap until the body of glue has set firmly to secure the glue flap to the side panel.

13. The long seam gluer set forth in claim 12, wherein said index folding wheel has two circumferentially spaced slots essentially diametrally therethrough for receiving a folded carton blank.

14. The long seam gluer set forth in claim 12, wherein said drive mechanism drives said vacuum wheel and said index folding wheel so that the adjacent surfaces thereof move in the same direction.

15. The long seam gluer set forth in claim 12, wherein said drive mechanism drives said vacuum wheel at a uniform rate and drives said index folding wheel stepwise to accommodate insertion of the leading edge of the carton blank into the slot in said index folding wheel.

16. The long seam gluer set forth in claim 12, wherein said leading vacuum cup is deactivated as the leading edge of the carton blank approaches said index folding wheel so that the leading edge of the carton blank springs away from the surface of said vacuum wheel to enter into the slot in said index folding wheel.

17. A long seam gluer for folding a carton blank into cylindrical form and forming a glued seam between the outer surface of a glue flap and a glue area on the inner surface of an overlying longitudinal side panel, said gluer comprising a magazine for holding a stack of the carton blanks on which a long glued seam is to be formed, feed mechanism for feeding carton blanks one at a time from said magazine in a predetermined direction with the longitudinal extent of the glue flap and the side panel normal to the predetermined direction, first folding mechanism for folding a first portion of the carton blank including the glue flap into a position overlying a remainder of the carton blank to leave exposed the outer surface of the glue flap, glue applying mechanism for applying a longitudinal body of glue to the glue flap as the glue flap is fed in the predetermined direction with the longitudinal extent of the glue flap normal to the predetermined direction, second folding mechanism for folding a second portion of the carton blank including the side panel into a position overlying a remainder of the carton blank to place the inner surface of the side panel over the body of glue on the glue flap, a freely rotatable drum mounted adjacent to said second folding mechanism and arranged to receive the folded carton blank on the circumference thereof, and a belt engaging a portion of the circumference of the drum and arranged to receive the folded carton blank between the belt and the circumference of said drum to press and hold the side panel against the body of glue on the glue flap until the body of glue has set firmly to secure the glue flap to the side panel.

18. The long seam gluer set forth in claim 17, wherein said belt extends at least 180° around the circumference of said drum.

19. The long seam gluer set forth in claim 17, and further comprising driving lugs engaging the outer ends of the trailing edges of the carton blanks to convey the carton blanks around said freely rotatable drum.

20. A long seam gluer for folding a carton blank into cylindrical form and forming a glued seam between the outer surface of a glue flap and a glue area on the inner surface of an overlying longitudinal side panel, said gluer comprising a magazine for holding a stack of the carton blanks on which a long glued seam is to be formed, feed mechanism for feeding carton blanks one at a time from said magazine in a predetermined direction with the longitudinal extent of the glue flap and the side panel normal to the predetermined direction, first folding mechanism for folding a first portion of the carton blank including the glue flap into a position overlying a remainder of the carton blank to leave exposed the outer surface of the glue flap, glue applying mechanism for applying a longitudinal body of glue to the glue flap as the glue flap is fed in the predetermined direction with the longitudinal extent of the glue flap normal to the predetermined direction, second folding mechanism for folding a second portion of the carton blank including the side panel into a position overlying a remainder of the carton blank to place the inner surface of the side panel over the body of glue on the glue flap, a first freely rotatable drum mounted adjacent to said second folding mechanism and a second freely rotatable drum mounted in alignment with said first drum and spaced therefrom, a first belt around said drums with said first drum arranged to receive the folded carton blank on a portion of said first belt at said first drum, and a second belt engaging a major portion of the outer surface of said first belt and arranged to receive the folded carton blank therebetween to press and hold the side panel against the body of glue on the glue flap for an extended period of time until the body of glue has set firmly to secure the glue flap to the side panel.

21. The long seam gluer set forth in claim 20, wherein said first belt and said second belt have widths essentially equal to the length of the glue seam to be formed whereby to hold the portions of the carton blank defining the glue seam firmly therebetween.

22. The long seam gluer set forth in claim 20, and further comprising a first set of driving lugs adjacent to said first drum and engageable with the outer portions of the trailing edges of the carton blanks, and a second set of driving lugs adjacent to said second drum and engaging the outer portions of the trailing edge of the carton blanks.

23. A long seam gluer for folding a carton blank into cylindrical form and forming a glued seam between the outer surface of a glue flap and a glue area on the inner surface of an overlying longitudinal side panel, said gluer comprising a magazine for holding a stack of the carton blanks on which a long glued seam is to be formed, feed mechanism for feeding carton blanks one at a time from said magazine in a predetermined direction with the longitudinal extent of the glue flap and the side panel normal to the predetemined direction, first folding mechanism for folding a first portion of the carton blank including the glue flap into a position overlying a remainder of the carton blank to leave exposed the outer surface of the glue flap, glue applying mechanism for applying a longitudinal body of glue to the glue flap as the glue flap is fed in the predetermined direction with the longitudinal extent of the glue flap normal to the predetermined direction, second folding mechanism for folding a second portion of the carton blank including the side panel into a position overlying a remainder of the carton blank to place the inner surface of the side panel over the body of glue on the glue flap, pressing mechanism to press and hold the side panel against the body of glue on the glue flap until the body of glue has set firmly to secure the glue flap to the side panel to form a flattened cylindrical carton, and a carton opening mechanism adjacent to said pressing mechanism for opening the flattened carton to receive an article therein.

24. The long seam gluer set forth in claim 23, wherein said carton opening mechanism includes a lower guide receiving the flattened carton from said pressing mechanism and an upwardly inclined guide connecting with an upper guide spaced from said lower guide a distance equal to the height of an opened carton, a carton conveyor having a plurality of lugs thereon disposed along one reach adjacent to said guide and spaced apart a distance equal to the width of an opened carton, said lugs having the outer ends thereof spaced apart immediately adjacent to the exit from said pressing mechanism so as to receive a flattened carton between two adjacent lugs with the outer ends spaced apart and with the carton between said guides whereupon placement of the upper ends of said lugs a distance apart equal to the width of a carton serves to open the flattened carton and to maintain the same between said upper and lower guides and an adjacent pair of said lugs.

25. A folding mechanism for folding a first portion of a carton blank including a glue flap therefor into a position overlying a remainder of the carton blank, said folding mechanism comprising a vacuum wheel having at least one leading vacuum cup on the circumference thereof and at least one trailing vacuum cup on the circumference thereof spaced circumferentially from said leading vacuum cup, said vacuum wheel receiving a carton blank with a first portion of the carton blank including the glue flap extending circumferentially beyond the leading vacuum cup with the remaining portions of the carton blank securely held against said vacuum wheel by said vacuum cup, a folding finger mounted adjacent to said vacuum wheel and shiftable between a first position adjacent to the vacuum wheel to engage the leading edge of the first portion of the carton blank and a second position spaced from said vacuum wheel, and drive mechanism driving said vacuum wheel to move the leading edge of the carton blank thereon into said folding finger when in the first position thereof and thereafter moving said folding finger to the second position thereof while rotating said vacuum wheel thereunder, said folding finger in the first position engaging the first portion of the carton blank, movement of said folding finger to the second position thereof effecting movement of the first portion of the carton blank therewith away from said vacuum wheel, and subsequent continued turning of said vacuum wheel causing the first portion of the carton blank held by said folding finger in the second position thereof to be folded into a position overlying the remaining portion of the carton blank to leave exposed the outer surface of the glue flap.

26. The folding mechanism set forth in claim 25, wherein at least two leading vacuum cups are provided in longitudinal arrangement and at least two trailing vacuum cups are provided in longitudinal arrangement.

27. The folding mechanism set forth in claim 25, wherein said vacuum wheel is provided with two sets of leading vacuum cups arranged circumferentially around said vacuum wheel and at least two sets of trailing vacuum cups respectively associated with said sets of leading vacuum cups around the circumference of said wheel.

28. The folding mechanism set forth in claim 25, wherein a recess is provided in the surface of said vacuum wheel ahead of said leading vacuum cup to receive said folding finger therein to assist engagement of said folding finger with the leading edge of a carton blank.

29. A folding mechanism for folding a second portion of a carton blank including a side panel into a position overlying a first portion of the carton blank including a glue flap, said folding mechanism comprising a vacuum wheel having at least one leading vacuum cup on the circumference thereof and at least one trailing vacuum cup on the circumference thereof spaced circumferentially from said leading vacuum cup to hold a carton blank thereon with a first portion of the carton blank including the glue flap overlying the remainder of the carton blank to leave exposed the outer surface of the glue flap, an index folding wheel adjacent to said vacuum wheel and having a slot essentially diametrally therethrough to receive the first portion and the underlying remaining portion of the carton blank therethrough upon release of said leading vacuum cup, and drive mechanism for causing relative rotation of said vacuum wheel and said index folding wheel to move the carton blank therebetween to fold a second portion of the carton blank including the side panel into a position overlying the remainder of the carton blank to place the inner surface of the side panel over the glue flap.

30. The folding mechanism set forth in claim 29, wherein said index folding wheel has two circumferentially spaced slots essentially diametrally therethrough for receiving a folded carton blank.

31. The folding mechanism set forth in claim 29, wherein said drive mechanism drives said vacuum wheel and said index folding wheel so that the adjacent surfaces thereof move in the same direction.

32. The folding mechanism set forth in claim 29, wherein said drive mechanism drives said vacuum wheel at a uniform rate and drives said index folding wheel stepwise to accommodate insertion of the leading edge of the carton blank into the slot in said index folding wheel.

33. The folding mechanism set forth in claim 29, wherein said leading vacuum cup is deactivated as the leading edge of the carton blank approaches said index folding wheel so that the leading edge of the carton blank springs away from the surface of said vacuum wheel to enter into the slot in said index folding wheel.

34. A pressing mechanism to press and hold the side panel of a carton blank against a glue flap on the carton blank with the body of glue therebetween, said pressing mechanism comprising a freely rotatable drum mounted to receive a folded carton blank on the circumference thereof, a freewheeling endless belt engaging a portion of the circumference of the drum and arranged to receive the folded carton blank between the belt and the circumference of the drum to press and hold the side panel against the body of glue on the glue flap until the body of glue has set firmly to secure the glue flap to the side panel, and driving lugs arranged to contact the outer portions of the trailing edge of the folded carton blank to drive the folded carton blank through part of its path between the belt and drum 35. The pressing mechanism set forth in claim 34, wherein said belt extends at least 180° around the circumference of said drum.

36. A pressing mechanism to press and hold the side panel of a carton blank against a glue flap on the carton blank with the body of glue therebetween, a first freely rotatable drum and a second freely rotatable drum mounted in alignment with said first drum and spaced therefrom, a first belt extending around said drums with said first drum arranged to receive a folded carton blank on a portion of said first belt at said first drum, a second belt engaging a major portion of the outer surface of said first belt and arranged to receive the folded carton blank therebetween to press and hold the side panel against the body of glue on the glue flap for an extended period of time until the body of glue has set firmly to secure the glue flap to the side panel, and two sets of driving lugs associated respectively with said drums and arranged to contact the outer portions of the trailing edges of the folded carton blanks to drive the folded carton blanks.

37. The pressing mechanism set forth in claim 36, wherein said first belt and said second belt have widths essentially equal to the length of the glue seam to be formed whereby to hold the portions of the carton blank defining the glue seam firmly therebetween.

38. A long seam gluer for folding a carton blank into cylindrical form and forming a glued seam between the outer surface of a glue flap and a glue area on the inner surface of an overlying longitudinal side panel, said gluer comprising a magazine for holding a stack of the carton blanks on which a long glued seam is to be formed, a suction cup mounted adjacent to said magazine for engaging a carton blank, first drive mechanism for said suction cup to draw the engaged carton blank from said magazine in a predetermined direction with the longitudinal extent of the glue flap in the side panel normal to the predetermined direction, a vacuum wheel adjacent to said suction cup and having at least one leading vacuum cup on the circumference thereof and at least one trailing vacuum cup on the circumference thereof spaced circumferentially from said leading vacuum cup, said suction cup delivering a carton blank to said vacuum wheel with a first portion of the carton blank therebetween including the glue flap extending circumferentially beyond said leading vacuum cup and with the remaining portion of the carton blank securely held against said vacuum wheel by said vacuum cups, a segment roll adjacent to said suction cup and operative to press an engaged carton blank against the surface of said vacuum wheel and into engagement with said vacuum cups, a folding finger engaging the first portion of the carton blank to pull the same into a position overlying the remaining portion of the carton blank to leave exposed the outer surface of the glue flap as said vacuum wheel and said folding finger are shifted relative to each other, glue applying mechanism for applying a longitudinal body of glue to the glue flap as the glue flap is fed in the predetermined direction with the longitudinal extent of the glue flap normal to the predetermined direction, an index folding wheel adjacent to said vacuum wheel beyond said glue applying mechanism and having a slot essentially diametrally therethrough to receive the first portion and the underlying remaining portion of the carton blank with the body of glue on the glue flap upon release of said leading vacuum cup, second drive mechanism for causing relative rotation of said vacuum wheel and said index folding wheel to move the carton blank therebetween to fold a second portion of the carton including the side panel into a position overlying the remainder of the carton blank to place the inner surface of the side panel over the body of glue on the glue flap, a freely rotatable drum mounted adjacent to said index folding wheel to receive a folding carton blank therefrom, a belt engaging a portion of the circumference of the drum and arranged to receive the folded carton blank to press and hold the side panel against the body of glue on the glue flap until the body of glue has set firmly to secure the glue flap to the side panel, and driving lugs arranged to contact the outer portions of the trailing edge of the folded carton blank to drive the folded carton blank.

* * * * *